US008692049B2

(12) United States Patent
Sirkó et al.

(10) Patent No.: US 8,692,049 B2
(45) Date of Patent: Apr. 8, 2014

(54) PROCESS AND APPARATUS FOR THE ANNIHILATION OF HARMFUL WASTE CONTAINING POLYCHLORINATED HYDROCARBONS

(76) Inventors: Imre Sirkó, Tahitótfalu (HU); György Mink, Budapest (HU); Péter Szabó, Dunaújváros (HU); Ernö Török, Zsámbék (HU); Szabolcs Fejes, Gyenesdiás (HU); István Lengyel, Budapest (HU)

( * ) Notice: Subject to any disclaimer, the term of this patent is extended or adjusted under 35 U.S.C. 154(b) by 213 days.

(21) Appl. No.: 13/498,061

(22) PCT Filed: Sep. 22, 2010

(86) PCT No.: PCT/IB2010/054276

§ 371 (c)(1), (2), (4) Date: Mar. 23, 2012

(87) PCT Pub. No.: WO2011/036629

PCT Pub. Date: Mar. 31, 2011

(65) Prior Publication Data

US 2012/0184798 A1 Jul. 19, 2012

(30) Foreign Application Priority Data

Sep. 24, 2009 (HU) ..... 0900602

(51) Int. Cl.
*A62D 3/33* (2007.01)

(52) U.S. Cl.
USPC ..... 588/315; 588/406; 423/240 S

(58) Field of Classification Search
USPC ..... 588/315, 406; 423/240 R, 240 S
See application file for complete search history.

(56) References Cited

U.S. PATENT DOCUMENTS

| | | | |
|---|---|---|---|
| 4,654,203 | A | 3/1987 | Maurer |
| 4,711,185 | A | 12/1987 | Hofmann |
| 5,491,281 | A | 2/1996 | Bhat |

FOREIGN PATENT DOCUMENTS

| | | |
|---|---|---|
| JP | 2002 253696 | 9/2002 |

*Primary Examiner* — Edward Johnson
(74) *Attorney, Agent, or Firm* — Allen, Dyer, Doppelt, Milbrath & Gilchrist, P.A.

(57) ABSTRACT

The present invention relates to a process consists of the hydrolytic decomposition of the polychlorinated hydrocarbons: of polychlorinated aliphatics and especially of polychlorinated aromatics and oxidizing the chlorine-free product at elevated temperature in the presence of a carrier gas in one unit characterized by a hot and a transitional temperature zone, whereby the calcium chloride and the exiting gas mixture are removed continuously and the excess heat of the highly exothermic process is utilized.
The present invention also relates to an apparatus for the process which is carried out in an Apparatus of FIG. 1.

9 Claims, 1 Drawing Sheet

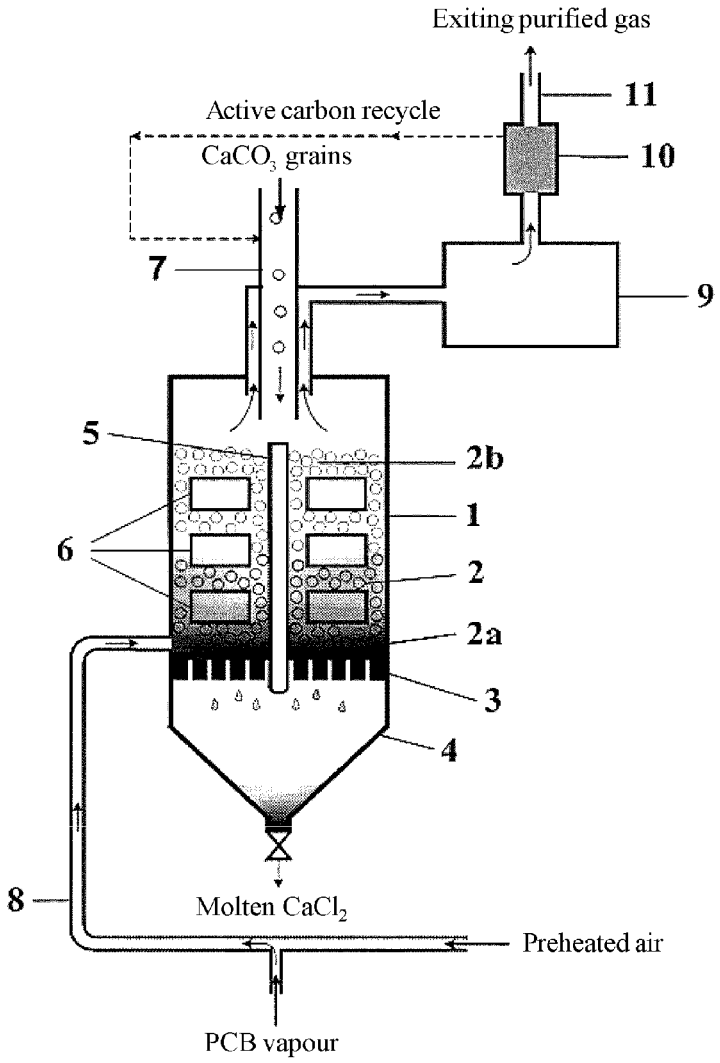
Exiting purified gas
11
Active carbon recycle
$CaCO_3$ grains
10
7
9
5
2b
1
6
2
2a
3
4
8
Molten $CaCl_2$
Preheated air
PCB vapour

PROCESS AND APPARATUS FOR THE ANNIHILATION OF HARMFUL WASTE CONTAINING POLYCHLORINATED HYDROCARBONS

This application is the §371 National Stage of International Application No. PCT/IB2010/054276, filed on Sep. 22, 2010 which, claims the benefit of Hungarian Application Serial No. P0900602, the contents of which applications are hereby incorporated by reference in their entirety.

TECHNICAL FIELD

The present invention relates to a process and apparatus for the annihilation of harmful waste containing polychlorinated hydrocarbons by using lime or limestone as a dehalogenation agent.

BACKGROUND ART

The Stockholm Convention aims to protect human health and the environment from Persistent Organic Pollutants (POPs). These synthetically made compounds are extremely harmful materials which since many decades have spread in the environment, poisoning the atmosphere, the surface water, the soil and the groundwater. Currently there are twelve chlorine containing POPs on the list of the Convention. Most of them are pesticides (Aldrin, Chlordene, Dieldrin, Endrin, Heptachlor, Hexachlorobenzene, Mirex, Toxaphene), agents against malaria vectors (DDT), compounds used in industry (polychlorinated biphenyls) and materials released during industrial activities (Polychlorinated dibenzo-p-dioxins and dibenzofurans, Hexachlorobenzene).

As a result of the inventory of the stocks, the export and import of such pollutants, the most serious problem turned out to be the annihilation of polychlorinated biphenyls (PCBs) oils containing PCBs like used transformer and hydraulic oils, lubricants, etc.

The polyhalogenated hydrocarbons, especially the aromatics, produced during decades are chemically very stable and persistent materials. There are 209 PCB congeners.

The utilization field of polychlorinated aromatics became much wider (cement and paint softeners, stabilizer additives for PVC, used as insulators in electric wires, fire retardants, cutting oils, lubricating oils, hydraulic oils, floor polishing materials, sealing compounds, vacuum oils, etc.). Their production peaked in the sixties. A large amount thereof entered the environment and thereby polluted soil, groundwater, rivers, lakes, oceans and air. As their natural biological decomposition is very slow, the elimination of the used polychlorinated aromatic hydrocarbons stored as wastes is a worldwide problem.

DISCLOSURE OF INVENTION

Technical Problem

The following methods were known for the dehalogenation of especially chlorinated aromatic hydrocarbons:

1. Oxidation in hazardous waste incinerators (United Nations Environmental Programme: Standardized toolkit for the identification and quantification of dioxin and furan releases, UNEP Chemicals, Geneva, Switzerland, Edition 2.1, December, pp 46-49). Nowadays large amount of polychlorinated aromatic hydrocarbons is eliminated in specially designed hazardous waste incinerators. According to the regulations, these technologies must be supplied with secondary combustion chambers operating at a temperature higher than 1200° C. It is necessary to hold the waste at high temperatures for sufficient time to ensure destruction. The longer the material is held at high temperature the more likely it will be destroyed. The residence time for gaseous substances is a minimum of 2 seconds. This temperature is reached by using fuels such as gasoline. Another requirement is that the oxygen excess should be minimum 50% in the secondary combustion chamber. Its structural materials are resistant to the generated hydrochloric acid even at such high temperatures. The investment costs are high, qualified staff is needed to operate the system. During start up and shut down other chlorinated organic pollutants are likely to form such as polychlorinated dibenzo-p-dioxins and dibenzofurans, hexachlorobenzene, etc. The process also generates side stream hazardous wastes, such as fly ash and bottom ash.

2. Microbiological methods—[Freeman, H., Hazardous Waste Treatment and Disposal. Emerging Bioprocesses, Mc Graw Hill. 9.47, 1997.] There are many research institutions dealing with biological destruction of polychlorinated aromatic hydrocarbons with micro-organisms to clean contaminated soil both in laboratory scale and on contaminated fields. Compared to other chemical methods the process is very slow. Fast results here are also not expectable. It was found that to a certain extent the processes are selective. Certain micro-organisms are able to destruct compounds with low chlorine content preferably at the meta- and para-positioned C—Cl bond. Their field application indicated that they were not selective; other organic materials were also decomposed.

3. Physical methods—Ultrasonic decomposition [Jennifer D. Schramm and Inez Hua, Ultrasonic Irradiation of Dichlorvos: Decomposition Mechanism, Water Research, Volume 35, Issue 3, February 2001, Pages 665-674, Guangming Zhang Inez Hua, Ultrasonic degradation of trichloroacetonitrile, chloropicrin and bromobenzene: design factors and matrix effects, Advances in Environmental Research, Volume 4, Issue 3, August 2000, Pages 219-224, Hoffmann, M. R., I. Hua and R. Höchemer, 1996. Application of ultrasonic irradiation for the degradation of chemical contaminants in water, Ultrasonics Sonochemistry, Volume 3, Issue 3, November 1996, Pages S163-S172]. Cavitational bubbles are formed with strong ultrasound waves in water solution of polychlorinated aromatic hydrocarbons. With their explosion or fragmentation, extreme high pressure and temperature micro regions are formed where the decomposition of polychlorinated aromatic hydrocarbons takes place. It is assumed that hydrolytically destructed is oxidizing the polychlorinated aromatic hydrocarbons to form carbon monoxide, carbon dioxide, and biphenyls, and the destructed chlorine is dissolved in water in its ionic form. The disadvantage of the method is that it can only be used for polychlorinated aromatic hydrocarbons containing few chlorine atoms and they should be water-soluble.

4. Radioactive irradiation—dissolved in iso-propanol or oil undergo gamma irradiation and their dehalogenation they will form biphenyl while subtracted chlorine atoms are bound to the additive potassium hydroxide. As an example from the USA, irradiation can come from the used heating element of a nuclear power plant.

5. Alkali hydrolysis of chlorine containing hydrocarbons—[Terres, S., Niederhull, W., Gallanger, W., Base-Catalized Decomposition Proven on Guam, Pollution Engineering, April, 1997] Hydrolysis is driven in autoclave at high temperature and pressure (400° C., 40 bar) in 30% sodium hydroxid solution. The organic chlorine is substituted by hydroxy group, with the formation of sodium chloride. In this reaction vicinal aliphatic chlorine compounds will form alcohols, geminal aliphatic chlorine compounds will give aldehydes, and polychlorinated aromatics will form polyhydroxybenzenes (polyphenols). After the reaction the aqueous and the organic phase has to be separated. The separation is difficult because the majority of the product is water soluble. Other disadvantages of this method are the following:

The process is of batch type,

The investment and operation costs are high,

The reagents are expensive and hazardous.

6. Substitution of chlorine by polyethylene glycol—[Tundo, P., Fachetti, S., Tumiatti, W., Fortunati, U., Chemical Degradation of 2,3,7,8-TCDD by Means of Polyethyleneglycols in the Presence of Weak Bases and Oxidant, Chemosphere 14 (5) 403-4010, 1985]. Polychlorinated aromatic hydrocarbons diluted in oil e.g. transformer oil, are reacting with polyethylene glycol in inert atmosphere via nucleophylic aromatic substitution. The formed aryl polyglycole is separated from the oil as precipitate.

7. Hydrogenation—the hydrogenolysis of the C—Cl bond—[EPA. 1994. "Eco Logic International Gas-Phase Chemical Reduction Process—The Thermal Desorption Unit. Superfund Innovative Technology Evaluation Program. EPA/540/AR-94/504. September. Online Address: ://www.epa.gov/ORD/SITE/reports/540ar94504/540ar94504.pdf, Eco Logic. 2002. "Contaminated Soil and Sediment Treatment Using the GPCRTM/TORBED® Combination." October. Online Address: http://www.torftech.com/start.htm., T. and K. R. Campbell, 1996. Bridle Destruction of Organiochlorine Compounds Using the Eco Logic Process. 3rd National Hazardous and Solid Waste Convention, Sydney, 26-30 May, 1996.] Hydrogen is reacting with polychlorinated aromatic hydrocarbons high temperature (700-920°) in a homogeneous gas phase reaction forming hydrochloric acid and biphenyl. The reaction can be carried out at a few hundred degrees lower temperature by using copper catalyst. The technology is expensive and needs a source of hydrogen and care.

8. Reaction with alkali metals or strong reduction agents—[Oku, A., T. Nakaji, T. Kamada, H. Miyata and O. Aozasa, 1993. Destruction of PCDDs and PCDFs in laboratory-scale wastes. A convenient reductive method with sodium naphthalene, Chemosphere, Volume 27, Issue 8, October 1993, Pages 1433-1438, Davies, W. A., Prince, R. G. H., 1994. Comparative feasibilities of processes for the destruction of organochlorines: Base-catalyzed dechlorination, sodium metal, hydrogen and electrolytic reduction processes. Process Safety and Environmental Protection: Transactions of the Institution of Chemical Engineers, Part B, v 72, n 2, May, 1994, p 113-115, Abraham S. C. Chen, Arun R. Gavaskar, Bruce C. Alleman, Audrey Massa, Dennis Timberlake and Eric H. Drescher: Treating contaminated sediment with a two-stage base-catalyzed decomposition (BCD) process: bench-scale evaluation, Journal of Hazardous Materials, Volume 56, Issue 3, October 1997, Pages 287-306] On the analogy of Wurtz synthesis, metallic sodium or e.g. sodium phenolate is reacting with polychlorinated aromatic hydrocarbons resulting in sodium chloride and polymeric products. By the formation of polymeric product, the vapour pressure and the water solubility decrease remarkably, increasing thereby the safety of the material. Because of the presence of metallic sodium the method is expensive and can easily cause explosion, therefore the raw materials should be completely de-waterized and the reaction should be undertaken under water-free environment (e.g.: under nitrogen blanketing).

9. Reduction with metal-organic Ti(III)—[Liu, Y., Z. Wei, Z. Feng, M. Luo, P. Ying and C. Li, 2001. Oxidative Destruction of Chlorobenzene and o-Dichlorobenzene on a Highly Active Catalyst: MnOx/TiO2—Al2O3, Journal of Catalysis, Volume 202, Issue 1, 15 Aug. 2001, Pages 200-204., Lomnicki, S., J. Lichtenberger, Z. Xu, M. Waters, J. Kosman and M. D. Amiridis, 2003. Catalytic oxidation of 2,4,6-trichlorophenol over vanadia/titania-based catalysts, Applied Catalysis B: Environmental, In Press, Corrected Proof, Available online 1 Aug. 2003.]. In the so called Schwarz reaction the metal organic Ti(III) compound is forming in electron transfer reaction an anion radical. This negative ion displaces the chlorine atom of the polychlorinated aromatic hydrocarbon. many steps it gradually decomposes to biphenyl.

Technical Solution

By meeting the disadvantages of the above technologies the aim of the present invention is to solve the problem of the dehalogenation of polyhalogenated hydrocarbons, especially the dechlorination of polychlorinated aromatics. It was surprisingly found that by using low cost and widely available lime or limestone as dechlorinating agent, the destruction efficiency reached 99.9999%. The method at the same time offers possibility for energy utilization of the wastes and generates technical quality calcium chloride as a valuable side-stream product.

The present invention relates to a process for the annihilation of harmful wastes containing polychlorinated hydrocarbons, especially polichlorinated aromatics by using low cost and widely available lime or limestone as dehalogenating agent.

The dehalogenation is carried out in the presence of water vapour and air in order to eliminate the formation of carbonaceous polymers and coke. Humid air is used as the carrier gas of the feedstock.

The process of the present invention is applicable for the dehalogenation of both polychlorinated aliphatic and aromatic hydrocarbons. The polychlorinated aliphatics have much lower bond strengths and therefore, much higher reactivity than the polyhalogenated aromatics. Consequently, the aim of the present invention is to find a process for the dehalogenation of the polychlorinated hydrocarbons, especially aromatics. This process can be easily applicable to all kind of polychlorinated aliphatics and aromatics.

Since polychlorinated aromatics have strong chemical bonds and high thermal and chemical stability, the dehalogenation process is carried out at an elevated temperature of 800-950° C. The reaction rate proved to be acceptably high in the given temperature interval. This temperature range is above the melting point of the calcium chloride and gives the possibility for the instant separation of liquid phase calcium chloride from the non-reacted limestone, therefore a hindering product layer could not develop and thus 100% of the limestone can be utilized for chlorine fixation. The dehalogenation of the polychlorinated hydrocarbons, especially aromatics occurs via their direct reaction with lime and/or hydrolytic decomposition and the oxidation of the chlorine-free products is carried out in one unit.

The present invention also relates to an apparatus of FIG. 1 for the dehalogenating process.

DESCRIPTION OF DRAWINGS

The schematic diagram of the dehalogenation unit can be seen in FIG. 1.

BEST MODE

The apparatus of FIG. 1 for the annihilation of harmful waste containing polychlorinated hydrocarbons: polyclorinated aliphatics and especially polychlorinated a aromatics is an 1 continuously operated vertical tube reactor with two temperature zones: 2*a* high temperature zone and a 2*b* transitional temperature zone, filled with 2 crashed gravels of limestone above a 3 grid, has a 4 silo for the collection of molten calcium chloride formed during the process, is equipped with 5 electric heater to preheat the system and 6 heat removal units for reactor cooling, has a 7 feeding pipe for limestone, a 8 gas inlet pipe for the preheated gaseous reaction mixture of the polychlorinated hydrocarbons with the carrier gas together, a 9 heat utilizer and fly dust separator units, a 10 adsorption tower filled with active carbon adsorbent and a 11 outlet pipe for the exiting purified gas.

The 1 continuously operated vertical tube reactor has two temperature zones: a 2*a* bottom layers of the high temperature zone that is kept at 800-950° C. and an 2*b* top layers of the upper transitional zone with monotonously decreasing temperature down to about 430-530° C. The temperature of the 2*a* bottom layers of the hot zone is kept preferably between 830° C. and 900° C. and the temperature of the top of the 2*b* transitional zone is kept preferably between 450° C. and 510° C.

The preheated gaseous reaction mixture of polychlorinated hydrocarbons and the carrier gas is introduced through 8 gas inlet pipe to the 2*a* hot zone where the chemical destruction processes (hydrolytic decomposition, dehalogenation, chlorine subtraction and fixation by limestone and oxidation) take place. The 2*b* transitional zone serves for the quantitative fixation of the hydrochloric acid which, for thermodynamical reasons, in some extent can escape from the 2*a* hot zone.

The reaction is highly exothermic. At start-up the 1 continuously operated vertical tube reactor should be preheated to its operational temperature by 5 electric heater, after starting the reaction heat regulation of the 2*a* hot zone and of the 2*b* transitional zone of the 1 continuously operated vertical tube reactor should be applied by 6 heat removal units for reactor cooling to ensure the required vertical temperature gradient in the with 2 limestone filled continuously operated vertical tube reactor.

Limestone is fed from a limestone silo automatically into the 1 continuously operated vertical tube reactor through 7 feeding pipe periodically with a level control, i.e. the level is continuously watched by an ultrasonic sensor.

Controlled amount of polychlorinated hydrocarbons is fed into the preheated air stream that enters the 1 continuously operated vertical tube through 8 gas inlet pipe.

Chlorine fixation results in the formation of molten calcium chloride, which flows by gravity from the 2*a* hot zone of the 1 continuously operated vertical tube reactor into the 4 calcium chloride silo through 3 grid that supports the solid charge. The molten calcium chloride is continuously removed. Calcium chloride is a marketable side product.

The gas mixture exiting the 1 continuously operated vertical tube reactor enters the 9 heat utilizer and fly dust separation units. The gas stream exiting the 9 units enters the active carbon adsorption tower at 30-50° C. for final purification. The used adsorbent then will be periodically recycled through the 7 feeding tube of the limestone stream. The purified gas stream containing nitrogen, excess oxygen, carbon dioxide and water exits the active carbon adsorption tower through 11 outlet pipe.

The advantages of the current process are as follows:

It requires lime or limestone as a reagent which is widely available and very cheap;

By utilizing the fact that at the temperature of the hot zone the calcium chloride is liquid and drips off from the solid calcium oxide particles, the reaction can be stoichiometric and fast. (Earlier experiments at lower temperature resulted in the deposition of calcium chloride product layer on the calcium oxide particles, which hindered the migration of chloride ions into the core of the calcium oxide particles. This significantly reduced the reaction rate and the effectiveness of the process.)

The generated technical grade calcium chloride can be sold on the market;

The process is environmentally sound, the formation of chlorinated organic pollutants, such as polychlorinated dibenzo-p-dioxins and dibenzofurans are thermodynamically not favoured and were not observed;

The process is safe, therefore it does not require strict occupational safety measures and advanced skills from the operating personnel;

The reaction is highly exothermic, thus the generated heat can be utilized through heat utilizer units;

The process is continuous, which reduces the labour costs needed for its operation;

The reaction chamber does not contain moving mechanical parts that can wear out during operation, which further improves its cost-effectiveness.

Special advantage of the above process is that there is not any harmful waste since even the used active carbon adsorbent is recycled into the dehalogenation process.

EXPERIMENTAL RESULTS

The laboratory scale reactor and the gas inlet tube that directs the reaction mixture just above the grid were made from sintered alpha-alumina tubes of ID=19 mm and ID=3 mm, respectively. With the help of periodical feeding the level of the solid charge was maintained at 80±10 mm above the grid. Thus, the average amount of limestone was kept around 30 g. The grid that separates the solid charge from the calcium chloride silo was made of ceramic material. The rest of the system was made of stainless steal.

The model compounds of the dehalogenation reactions were 1,2-dichlorobenzene (1,2-DCB) and 1,3-dichlorobenzene (1,3-DCB). These compounds are very similar to the commercial polychlorinated biphenyls (PCBs) both in terms of their chemical structure and their high (almost 50 w %) chlorine content. The carrier gas of dichlorobenzene (and at the same time the oxidation agent) was humidified synthetic air with controlled flow rate.

During the experiments the gas phase concentration of the water vapour and the dichlorobenzene (DCB) and the temperature of the air entering the reaction were controlled precisely.

Our analytical instrumentation enabled us to analyse the outlet gas for possible side products like hydrochloric acid, carbon monoxide, chlorinated dioxins, furans or other chlorinated heavy compounds (dimers or olygomers), but except trace amounts of non-reacted diclorobenzenes neither of them could be observed. The exhaust gas were analysed by on-line GC (Gas Chromatograph) supplied with an ECD (Electron Capture Detector). The overall reaction may be written as $$C_6H_4Cl_2(gas)+6.5O_2(gas)+CaCO_3(solid)=CaCl_2(liquid)+7CO_2(gas)+2H_2O(gas)$$

Results are collected in Tables 1-6 Results given in Tables 1-3 refer to the destruction of 1,2-dichlorobenzene and Table 4 shows the results of the destruction of 1,3-dichlorobenzene. Table 5 shows the results of the destruction of 1,2- and 1,3-dichlorobenzene, and results obtained for the destruction of different chlorinated aliphatics under steady state conditions are given in Table 6.

TABLE 1

Destruction of 1,2-DCB at 800° C. hot zone and 100, 148 and 210 N-ml/min air flow rates (The melting point of CaCl2 is 772° C.)

| Time (min) | Air flow rate (N-ml/min) | 1,2-DCB in (ppm) | 1,2-DCB out (ppm) | Destruction efficiency |
|---|---|---|---|---|
| 0 | 100 | 70035 | 0 | 0 |
| 30 | 100 | 70035 | 0.866 | 0.9999870 |
| 55 | 100 | 70035 | 0.412 | 0.9999938 |
| 80 | 100 | 70035 | 0.276 | 0.9999958 |
| 105 | 100 | 70035 | 0.235 | 0.9999964 |
| 145 | 100 | 70035 | 0.115 | 0.9999982 |
| 165 | 148 | 70035 | ≤0.010 | ≥0.9999998 |
| 190 | 210 | 70035 | ≤0.010 | ≥0.9999998 |
| 215 | 210 | 70035 | ≤0.010 | ≥0.9999998 |
| 240 | 210 | 70035 | ≤0.010 | ≥0.9999998 |
| 320 | 210 | 70035 | 2.298 | 0.9999655 |
| 345 | 210 | 70035 | 1.682 | 0.9999747 |
| 370 | 210 | 70035 | 0.978 | 0.9999853 |
| 395 | 210 | 70035 | 1.589 | 0.9999761 |
| 408 | 210 | 70035 | 1.201 | 0.9999819 |
| 445 | 210 | 70035 | 0.968 | 0.9999854 |
| 470 | 210 | 70035 | 0.543 | 0.9999918 |
| 495 | 210 | 70035 | 0.717 | 0.9999892 |

As Table 1 shows, acceptable 99.999% destruction efficiency corresponding to the minimum requirement was achieved at 800° C. just above the melting point of calcium chloride. It is also seen that without compromising this efficiency the load on the solid charge could be increased from 100 N-ml/min to 210 N-ml/min. Nevertheless, the outlet gas needs to be purified further by other means since the residual concentration of 1,2-dichlorobenzene was in the ppm range.

TABLE 2

Destruction of 1,2-DCB at 850° C. and 210 N-ml/min air flow rate

| Time (min) | Air flow rate (N-ml/min) | 1,2-DCB in (ppm) | 1,2-DCB out (ppm) | Destruction efficiency |
|---|---|---|---|---|
| 0 | 210 | 70035 | 0 | 0 |
| 155 | 210 | 70035 | 1.589 | 0.9999761 |
| 178 | 210 | 70035 | 1.201 | 0.9999819 |
| 205 | 210 | 70035 | 0.968 | 0.9999854 |
| 230 | 210 | 70035 | 0.543 | 0.9999918 |
| 255 | 210 | 70035 | 0.717 | 0.9999892 |
| 475 | 210 | 70035 | 0.494 | 0.9999925 |
| 500 | 210 | 70035 | 1.014 | 0.9999847 |
| 525 | 210 | 70035 | 1.140 | 0.9999829 |
| 555 | 210 | 70035 | 0.427 | 0.9999935 |
| 595 | 210 | 70035 | 0.371 | 0.9999944 |
| 620 | 210 | 70035 | 0.590 | 0.9999911 |
| 645 | 210 | 70035 | 0.274 | 0.9999958 |

Table 2 collects the results obtained with 1,2-dichlorobenzene at 850° C. In spite of the elevated temperature the destruction efficiency is still 4-5 nines with a residual dichlorobenzene concentration of about one ppm, similarly as in the former case.

TABLE 3

Destruction of 1,2-DCB at 900° C. and at 400 and 500 N-ml/min air flow rate

| Time (min) | Air flow rate (N-ml/min) | 1,2-DCB in (ppm) | 1,2-DCB out (ppm) | Destruction efficiency |
|---|---|---|---|---|
| 0 | 400 | 70035 | 0 | 0 |
| 160 | 400 | 70035 | 0.220 | 0.9999967 |
| 185 | 400 | 70035 | 0.348 | 0.9999947 |
| 220 | 400 | 70035 | 0.175 | 0.9999973 |
| 245 | 400 | 70035 | 0.414 | 0.9999937 |
| 275 | 400 | 70035 | 0.151 | 0.9999977 |
| 300 | 400 | 70035 | 0.167 | 0.9999974 |
| 325 | 400 | 70035 | 0.139 | 0.9999979 |
| 360 | 500 | 70035 | 1.111 | 0.9999833 |
| 385 | 500 | 70035 | 1.292 | 0.9999806 |
| 410 | 500 | 70035 | 0.857 | 0.9999871 |
| 435 | 500 | 70035 | 0.628 | 0.9999905 |
| 460 | 500 | 70035 | 1.038 | 0.9999844 |
| 500 | 500 | 70035 | 0.836 | 0.9999874 |
| 530 | 500 | 70035 | 0.496 | 0.9999956 |

Results in Table 3 were obtained also with 1,2-dichlorobenzene but at even higher temperature (900° C.) and at increased (400 and 500 N-ml/min) gas flow rates. As in the previous cases the destruction efficiency is 4-5 nines with about 1 ppm residual dichlorobenzene concentration. However, a significant benefit of the increased temperature is that the load on the reactor could be increased to 500 N-ml/min, which is significant advantage in the industrial application of the method.

TABLE 4

Destruction of 1,3-DCB at 900° C. and 500 N-ml/min air flow rate

| Time (min) | Air flow rate (N-ml/min) | 1,3-DCB in (ppm) | 1,3-DCB out (ppm) | Destruction efficiency |
|---|---|---|---|---|
| 0 | 500 | 100000 | 0.000 | 0 |
| 25 | 500 | 100000 | ≤0.010 | ≥0.9999999 |
| 65 | 500 | 100000 | ≤0.010 | ≥0.9999999 |
| 390 | 500 | 100000 | 0.189 | 0.9999980 |
| 425 | 500 | 100000 | ≤0.010 | ≥0.9999999 |
| 480 | 500 | 100000 | 0.095 | 0.9999990 |
| 575 | 500 | 100000 | ≤0.010 | ≥0.9999999 |
| 685 | 500 | 100000 | ≤0.010 | ≥0.9999999 |

Table 4 refers to the destruction of 1,3-dichlorobenzene, a structural isomer of 1,2-dichlorobenzene. The reactions were carried out also at 900° C. and 500 N-ml/min air flow rate but the inlet concentration of 1,3-dichlorobenzene was about 50% higher than in the previous case, Cf., Table 3.

TABLE 5

Destruction of 1,2-DCB and 1,3-DCB at 900° C. hot zone temperature and 500 N-ml/min air flow rate

| COM-POUND | Air flow rate* (N-ml/min) | CaCO3 charged (g) | Av. height of the charge (mm) | DCB in (ppm) | Destruction efficiency |
|---|---|---|---|---|---|
| 1,2-DCB | 500 | 30 | 80 | 70000 | ≥0.9999806 |
| 1,3-DCB | 500 | 30 | 80 | 100000 | ≥0.9999980 |

*Air that contains 3% water vapour

Table 5 shows that in spite of the increased load excellent destruction efficiency could be achieved with 1,3-DCB, one order of magnitude better than in the case of the 1,2-DCB isomer.

TABLE 6

Average steady state destruction efficiency obtained for the most commonly used chlorinated aliphatics at 900° C. hot zone temperature, 500 N-ml/min air flow rate and 70000 ± 1000 ppm inlet concentrations

| Starting material | Air flow rate (N-ml/min) | Inlet concentration (ppm) | Outlet* concentration (ppm) | Destruction efficiency |
|---|---|---|---|---|
| Chloroform | 500 | 70600 | ≤0.010 | ≥0.9999998 |
| Carbon tetrachloride | 500 | 69400 | ≤0.010 | ≥0.9999998 |
| Trichloro ethylene | 500 | 70100 | ≤0.010 | ≥0.9999998 |
| Tetrachloro ethylene | 500 | 70900 | ≤0.010 | ≥0.9999998 |

*Outlet concentration means the summarized concentration of the starting material and its chlorine containing side products like Methyl chloride, Dichloro methane, Monochloro- and Dichloro ethylenes, etc.

Table 6 summarises the average destruction efficiency of several chlorinated aliphatics under steady state conditions.

A comparison of Table 6 with the previous Tables clearly shows that chlorinated aliphatics can be more easily and more efficiently destroyed than the chlorinated aromatics, in harmony with our expectations based upon the difference in the bond strengths and the chemical and thermal stability of these two groups of the starting materials.

| List of reference signs | |
|---|---|
| 1 | Continuously operated vertical tube reactor |
| 2a | Hot temperature zone |
| 2b | Transitional temperature zone |
| 2 | Crashed gravels of limestone |
| 3 | Grid |
| 4. | Silo to collect the molten calcium chloride |
| 5 | Electric heater to preheat the system |
| 6 | Heat removal units for reactor cooling |
| 7 | Feeding pipe for limestone |
| 8 | Gas inlet pipe for the gaseous reaction mixture |
| 9 | Heat utilizing and fly dust separation units |
| 10. | Adsorption tower filled with active carbon |
| 11. | Outlet pipe for the exiting purified gas |

The invention claimed is:

1. Process for annihilation of harmful waste containing polychlorinated hydrocarbons: polychlorinated aliphatics and especially polychlorinated aromatics by using lime or limestone as dehalogenation and chlorine fixation agent, which process consists of the hydrolytic decomposition of the polychlorinated hydrocarbons: of polychlorinated aliphatics and especially of polychlorinated aromatics and oxidizing the chlorine-free product at elevated temperature in the presence of a carrier gas in one unit characterized by a hot and a transitional temperature zone, whereby the calcium chloride and the exiting gas mixture are removed continuously and the excess heat of the highly exothermic process is utilized.

2. Process according to claim 1 characterized in that the dehalogenation is carried out in the hot zone at a temperature of 800-950° C., preferably 830-900° C., i.e. above the melting point of calcium chloride.

3. Process according to claim 2 characterized in that humid air is used as carrier gas to transport vapour phase polychlorinated hydrocarbons.

4. Process according to claim 1 characterized in that the feed of the solid crashed gravels of limestone is automated by level control and the feed of the polychlorinated hydrocarbons together with the humid air is continuous.

5. Process according to claim 1 characterized in that the molten calcium chloride formed during the dehalogenation and chlorine fixation processes flows by gravity from the hot zone into a calcium chloride collection silo, and thus, it is separated continuously.

6. Process according to claim 1 characterized in that the gas exiting the reactor containing nitrogen, excess oxygen, carbon dioxide and water is continuously removed from the transitional zone and after post purification and quality control it is rejected to the atmosphere.

7. Process according to claim of 1 characterized in that the reaction heat of the highly exothermic dehalogenation, chemical fixation and chemical oxidation processes are utilized in high capacity heat utilizers.

8. Apparatus of FIG. 1 for the annihilation of harmful waste containing polychlorinated hydrocarbons: polychlorinated aliphatics and especially polychlorinated aromatics by a process according to claim of 1 which comprises a continuously operated vertical tube reactor (1) with two zones (2*a* and 2*b*) filled with crashed gravels of limestone (2) above a grid (3), has a silo (4) for collection of the molten calcium chloride formed, equipped with electric heater (5) to preheat the system and heat removal units for reactor cooling (6), has a feeding pipe of limestone (7), a gas inlet pipe for the reaction mixture of the polychlorinated hydrocarbons and the carrier gas (8), heat utilising and fly dust separation units (9), an adsorption tower (10) filled with active carbon adsorbent and an outlet pipe for the purified outlet gas (11).

9. Apparatus according to claim 8 characterized in that the two temperature zones consist of a lower hot zone (2*a*) kept at 800-950° C., preferably at 830-900° C. and then an upper transitional zone (2*b*) with monotonously decreasing temperature down to about 430-530° C., preferably 450-510° C.

* * * * *